US008167410B2

(12) United States Patent
Horike et al.

(10) Patent No.: US 8,167,410 B2
(45) Date of Patent: May 1, 2012

(54) IMAGE FORMING APPARATUS

(75) Inventors: Masanori Horike, Kanagawa (JP); Fuyuhiko Matsumoto, Saitama (JP); Masanori Saitoh, Tokyo (JP); Nobuaki Kondoh, Kanagawa (JP); Shin Kayahara, Kanagawa (JP); Osamu Endou, Kanagawa (JP); Tomoko Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 343 days.

(21) Appl. No.: 12/555,368

(22) Filed: Sep. 8, 2009

(65) Prior Publication Data

US 2010/0061751 A1 Mar. 11, 2010

(30) Foreign Application Priority Data

Sep. 11, 2008 (JP) ..... 2008-232873

(51) Int. Cl.
*B41J 2/06* (2006.01)

(52) U.S. Cl. ..... 347/55

(58) Field of Classification Search ..... 347/55, 347/140, 155, 156, 158, 103, 101, 212; 399/67, 399/110, 111, 119, 120, 252, 262, 325, 339, 399/340, 341; 430/124.1
See application file for complete search history.

(56) References Cited

U.S. PATENT DOCUMENTS

| | | | | |
|---|---|---|---|---|
| 5,955,228 | A | 9/1999 | Sakai et al. | |
| 6,398,345 | B1 | 6/2002 | Sakai et al. | |
| 7,655,374 | B2 * | 2/2010 | Katano et al. | 430/124.1 |
| 7,689,145 | B2 * | 3/2010 | Nakamura et al. | 399/110 |
| 2006/0045572 | A1 * | 3/2006 | Hongawa et al. | 399/237 |
| 2009/0041492 | A1 | 2/2009 | Horike et al. | |

FOREIGN PATENT DOCUMENTS

| | | |
|---|---|---|
| JP | 57-198470 | 12/1982 |
| JP | 59-181370 | 10/1984 |
| JP | 63-136058 | 6/1988 |
| JP | 2-226261 | 9/1990 |
| JP | 2-52260 | 11/1990 |
| JP | 5-29479 | 7/1993 |
| JP | 6-5396 | 1/1994 |
| JP | 2933930 | 5/1999 |
| JP | 11-301014 | 11/1999 |
| JP | 2001-505146 | 4/2001 |
| JP | 2009-39948 | 2/2009 |
| JP | 2009-42500 | 2/2009 |

* cited by examiner

*Primary Examiner* — Kristal Feggins
(74) *Attorney, Agent, or Firm* — Oblon, Spivak, McClelland, Maier & Neustadt, L.L.P.

(57) ABSTRACT

The present invention provides an image forming apparatus, which is able to prevent the adherence of toner on the surface of toner controlling means and around a toner passage hole, and to stably carry out toner passage ON/OFF control when forming an image using the direct recording method. This image forming apparatus includes: a toner carrier; recording medium means; toner controlling means, disposed between the toner carrier and recording medium means, and having a plurality of toner passage holes; and cloud electrode means disposed between the toner carrier and toner controlling means, a toner cloud being formed by applying an AC bias between the toner carrier and cloud electrode means. A control electrode and a common electrode are disposed in toner controlling means, and when the toner of the toner carrier is able to pass through the toner controlling means toward recording medium means, a loop-shaped line of electric force is formed between the recording medium means side and the toner controlling means common electrode, the loop-shaped line by-passing the control electrode.

15 Claims, 7 Drawing Sheets

IMAGE FORMING APPARATUS

BACKGROUND OF THE INVENTION

1. Field of the Invention

The present invention relates to an image forming apparatus, and more particularly to an image forming apparatus that forms an image by causing a toner, which has been made to fly from a toner carrier, to adhere to recording medium means by being flown via toner passage holes, the opening and closing of which are controlled.

2. Description of the Related Art

An image forming apparatus of the type that directly records an image on a recording medium (comprising an intermediate recording medium) using toner (a recording material), which is called toner jet, direct toning, toner projection and the like, is known as a conventional image forming apparatus.

For example, Examined Utility Model Application Publication No. H5-29479 (referred to as Prior Art 1) discloses a configuration, which has a grid electrode disposed by way of an insulating layer between a toner container and a control member comprising a pair of electrode plates, and which forms an image by applying an alternating voltage to the grid electrode to convert the toner into a cloud. This configuration makes possible image formation without the need for an exposure optical system and electrostatic latent image, but, in principle, is not able to avoid the adherence of toner to the electrode plates of the control member, and the buildup of toner on the electrode plates gives rise to a dramatic drop in control performance.

Japan Patent Laid-open Publication No. S57-198470 (referred to as Prior Art 2) discloses a configuration in which a grid electrode is disposed between a toner carrying surface and a latent image carrying surface, and a toner cloud is formed by applying an alternating current voltage between the grid and toner carrying surface. In this configuration, it is possible to make the latent image carrying surface spacing sufficiently larger than that of the so-called jumping development system, which applies an alternating current bias between the toner carrying surface and the latent image carrying surface, and although a toner cloud is capable of being formed without affecting the development bias condition, it remains within the domain of the conventional image forming apparatus in that it requires an exposure optical system and an electrostatic latent image.

Japan Patent Laid-open Publication No. S63-136058 (referred to as Prior Art 3) discloses an image forming apparatus that uses frictional electrification between either fixed plates or rotating rollers to apply an electrification charge to toner supplied from a toner hopper, and after rotational feeding, controls the flight of the toner with an electric field between a control pulse applied to a control member and the rotating rollers. Toner having an electrification charge is electrostatically adhered to the surface of the rotating roller here, and this toner must be separated using a control pulse. This is problematic in that, since there is a gap of several hundred micrometers or more between the rotating roller and the control member, the control pulse applied for separation must inevitably have a high voltage of 500 V or more, and the cost of the driver needed to control the number of picture elements is extremely expensive. Another problem is poor responsiveness and time delays associated with causing the toner adhered to the rotating roller to separate and fly.

Japanese Patent 2933930 (referred to as Prior Art 4) and Japanese Examined Patent Application Publication No. H2-52260 (referred to as Prior Art 5) disclose an image forming apparatus that applies a control pulse to a control electrode through which the developer passes, while applying an alternating bias between a rotating developer support and control means. Although this configuration alleviates the problem of responsiveness associated to the apparatus disclosed in the above-mentioned Prior Art 3, a uniform alternating field is applied to the entire flying area of the toner, and the flying state and time that the developer is adhered to the developer support are repeated. For this reason, a strong alternating bias must be applied for separating the developer that is adhered to the developer support, causing a major reliability problem in that there is no way to avoid the separated toner flying with great force to control means side, and large amounts of developer adhering to the control means electrode. Furthermore, this configuration cannot solve the problem of driver cost since the same gap as mentioned hereinabove exists between the developer support and control means, and the voltage value applied between the two is high (500 V or more), requiring that the control pulse for forming the field that either passes or blocks the developer to/from this field be a similarly high voltage value.

By contrast, Japanese Patent Laid-open Publication No. S59-181370 (referred to as Prior Art 6) discloses a configuration, which has a plurality of electrodes in a developer carrier, and causes the toner to fly to the control electrode side by forming a temporally changing electric field between these electrodes. Since the passage of toner that is flying and floating in the proximity of the control electrode is controlled here, the problem of the high control voltage of the apparatuses of Prior Art 3 through Prior Art 5 is resolved.

Japan Patent Laid-open Publication No. H02-226261 (referred to as Prior Art 7), similar to the above Prior Art 6, discloses a configuration, which has a plurality of electrodes in a developer carrier, and which causes the toner to fly by forming a temporally changing electric field between these electrodes, and a control electrode for controlling the passage of the toner, which had heretofore been installed on the recording medium side, is installed on the toner supply side. It is disclosed that in this configuration, the control voltage, which had to be 400 V in the conventional apparatus, may be 100 V, and when the toner that adheres to the print head, on which the control electrode is provided, is removed, this toner may be returned to the toner supply source.

Further, Japanese Translation of PCT Application No. 2001-505146 (referred to as Prior Art 8) discloses a configuration, which uses a rotating cylindrical sleeve to supply toner, and which applies an electrostatic force that allows the toner to pass through an aperture via a uniform electrical field between the print head surface potential and the sleeve, provides a deflecting electrode that is paired on the print head surface side with the control electrodes surrounding the aperture, and raises the print dot density in the main scanning direction. It is disclosed that a guard electrode is disposed between the control electrodes that control the passage of the toner here to prevent interaction between the control fields.

Japanese Patent Laid-open Publication No. H11-301014 (referred to as Prior Art 9) discloses the disposition of a control electrode, which supplies toner via a toner supply roller, and which controls the flight of the toner on the toner supply roller side of the aperture containing member, and a deflecting electrode, which deflects the flight path of the toner.

Such direct recording-type image forming apparatuses proposed in the past have numerous problems that need to be solved, such as those described above.

Technologies relating to the present invention are also disclosed in, e.g., Japanese Patent Laid-open Publication No. H06-005396.

SUMMARY OF THE INVENTION

An object of the present invention is to provide a direct recording-type image forming apparatus that is able to use a simple configuration to form a toner cloud.

Another object of the present invention is to provide a direct recording-type image forming apparatus that is able to reduce the adherence of toner on the surface of toner controlling means and around a toner passage hole.

Another object of the present invention is to provide a direct recording-type image forming apparatus that is able to stably carry out the ON/OFF control of toner passage using a low voltage.

Another object of the present invention is to provide a direct recording-type image forming apparatus that is able to enhance the utilization effectiveness of the toner.

Another object of the present invention is to provide a direct recording-type image forming apparatus that is able to achieve miniaturization and cost savings.

In an aspect of the present invention, an image forming apparatus comprises a toner carrier for carrying a toner; a recording medium device to which the toner is made to adhere; a toner controlling device, disposed between the toner carrier and the recording medium device, and having a plurality of toner passage holes; and a cloud electrode device, disposed between the toner carrier and the toner controlling device. An AC bias is applied between the toner carrier and the cloud electrode device to temporally change between an electric field, in which force to move toner from the toner carrier to the cloud electrode device is acted, and an electric field, in which force is acted in an opposite direction thereto. A control electrode for controlling passage of the toner is disposed at least in either an area surrounding the toner passage hole or on an inner wall of this hole on a surface of the toner controlling device on a side of the toner carrier. When the toner of the toner carrier is able to pass through the toner passage hole of the toner controlling device toward the recording medium device, a loop-shaped line of electric force is formed between the recording medium device side and the common electrode of the toner controlling device, the loop-shaped line by-passing the control electrode.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Figure 1:
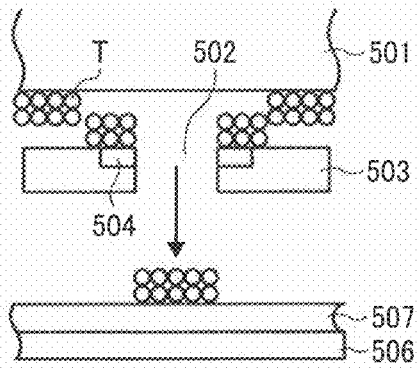
FIG. 1 PRIOR ART
FIG. 1 is a diagram schematically showing the basic configuration of a conventional direct recording-type image forming apparatus.

Prior to explaining the present invention, the prior art of the present invention and the problems associated therewith will be explained by referring to the drawings.

The basic configuration for forming an image using the conventional direct recording method, for example, is configured as shown in FIG. 1. In this figure, a toner carrying roller 501 is disposed as an agent carrier such that its axis extends in the left-right direction in the drawing, and carries charged toner T on its surface while being rotationally driven by driving means not shown in the drawing. A flexible printed circuit board 503 is disposed below this toner carrying roller 501 as a hole forming member for forming a plurality of holes 502. The FPC 503 comprises a plurality of flight electrodes 504 in a ring shape formed opposite the toner carrying roller 501 so as to surround the respective holes 502.

Then, down below the above-mentioned FPC 503, there are disposed a counter electrode 506 that faces the toner carrying roller 501 by way of this FPC 503, and a recording paper 507 that is conveyed via conveying means on top of this counter electrode 506. Furthermore, for the sake of convenience, only one each of the holes 502 and flight electrodes 504 are shown in FIG. 1, but in actuality, a plurality of combinations of these holes 502 and flight electrodes 504 are formed in the FPC 503. Specifically, for example, in a 600 dpi FPC 503, 4960 combinations of these holes 502 and flight electrodes 504 are formed.

Accordingly, the toner carrying roller 501, for example, is in a grounded state, and carries on its surface toner T, which is charged to minus polarity. When a plus polarity flight voltage is applied to the above-mentioned flight electrode 504, an electric field of a prescribed strength acts on the toner T located opposite the flight electrode 504 on the toner carrying roller 501, and on the toner T in the vicinity thereof. An electrostatic force applied to the toner T in accordance with the effect of this field exceeds the adhesive force between the toner T and the toner carrying roller 501, and an aggregate of toner T selectively flies from the toner carrying roller 501 in the shape of a dot, and enters inside the hole 502.

Then, the dot-shaped aggregate of toner T continues to fly pulled by an electric field formed between the flight electrode 504 and the above-mentioned counter electrode 506, which takes on a higher electric potential than this flight electrode 504, passes through the hole 502 and adheres to the surface of the above-mentioned recording paper 507. In accordance with this adherence, the toner T aggregate becomes a dot image.

In this case, respective specialized ICs must individually control the ON/OFF of the flight voltage for the respective flight electrodes 504. That is, in a direct recording type image forming apparatus, the same number of expensive ICs as the number of flight electrodes 504 is needed in a case where the voltage is high. For example, when using a 600 dpi FPC 503, 4960 expensive switching elements must be provided. Generally speaking, an IC becomes more expensive the higher the withstand voltage thereof due to the greater chip surface area required, and in a direct recording type image forming apparatus, the extent to which the control voltage can be lowered becomes an important element in the effort to lower the cost of the apparatus.

However, adhesive forces that attract one another as a result of mirror image force, van der Waals forces, liquid bridging force and so forth act on the toner T and toner carrying roller 501, and this prevents the flight voltage from being lowered. As a result of this, it is necessary to apply at least 500 V or more of flight voltage in the apparatus shown in FIG. 1.

By contrast, it is possible to lower the voltage applied to the flight electrode by employing a configuration, like that disclosed in the above-mentioned Prior Art 6, which has a plurality of electrodes on the developer carrier, creates a toner cloud by forming a temporally changing electric field between these electrodes, and causes the toner to fly to the control electrode side.

However, the problem is that because the toner is made to fly by generating a strong electric field via the reciprocal application of electric potential differences between the plurality of micro-pitch electrodes provided on the developer carrier, the flying toner adheres to the surface of the control electrode and the toner accumulates, and the toner also adheres around the perimeter of the holes through which the toner passes, over time causing the amount of toner passing through these holes to fluctuate and raising the likelihood of fluctuations occurring in image density.

Further, the toner cloud, which flies from the surface of the developer carrier, is distributed height-wise, worsening the utilization efficiency of the toner that passes through toner passage holes by simply applying a control pulse to the control electrode and making it difficult to assure printing speed. Another problem is that the adherence of the toner cloud is not limited to the control electrode, which continuously utilizes this toner in a static state, but rather the toner cloud also adheres to and accumulates on the members surrounding this control electrode. As a result, the electric potentials of all the members forming the control electrode rise to electric potentials in the direction corresponding to the charging polarity of the toner, acting on the flight of the toner from the surface of the developer carrier as a reverse bias field and causing lower flight efficiency.

An embodiment of the present invention will be explained below by referring to the accompanying drawings.

Figure 2:
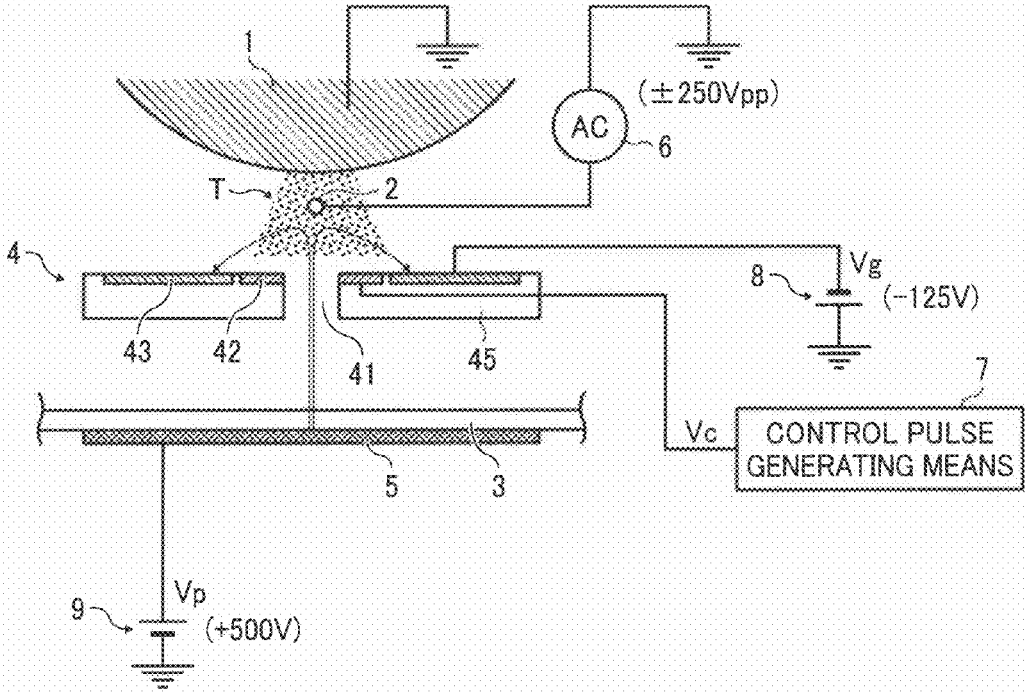
FIG. 2 is a diagram schematically showing the configuration related to a first embodiment of the present invention.

This embodiment, as shown in FIG. 2, comprises a toner carrier 1, which carries a toner T, recording medium means 3 to which the toner adheres, toner controlling means 4, which is disposed between the toner carrier 1 and recording medium means 3 and has a plurality of toner passage holes 41, cloud electrode means 2, which is disposed between the toner carrier 1 and toner controlling means 4, and counter electrode means (back electrode), which is disposed in a location facing the toner carrier 1 and applies a bias voltage for causing the toner to fly from the toner carrier 1 side to recording medium means 3.

The toner carrier 1 has a thin layer of pre-charged toner T on its surface, and the toner is transported by the rotation of the toner carrier 1. This embodiment has cloud electrode means 2 in a location that is slightly separated from this toner carrier 1, and a toner T cloud is created by using AC bias applying means 5 to apply an AC bias between this cloud electrode means 2 and the toner carrier 1.

Cloud electrode means 2 may be a configuration in which either one or a plurality of wire members having a diameter of between 0.05 and 0.1 mm is disposed in an area corresponding to the cross direction of a below-described control electrode 42 of toner controlling means 4, or a configuration in which a wire having a diameter of between 0.05 and 0.1 mm is woven into a mesh shape.

By setting the spacing between cloud electrode means 2 and the toner carrier 1 to an extremely short distance of between 0.02 and 0.06 mm, cloud formation becomes possible by forming an electric field for separating the toner from the surface of the toner carrier 1.

The configuration is such that the width of cloud electrode means 2 in the toner transport direction corresponds to the number of rows of toner passage holes 41 in toner controlling means 4, and in the case of the wire member, it has been ascertained that the required toner cloud is obtained using from one to around four wire members.

As for the AC bias applied between cloud electrode means 2 and the toner carrier 1 here, the configuration is such that the toner carrier 1 is grounded and set to 0 V, and ±250 Vpp is applied to cloud electrode means 2. The electric potential difference of this AC bias also acts, for example, to separate the toner adhered to the wire that comprises cloud electrode means 2 while at the same time separating the toner that is adhered to the surface of the toner carrier 1, requiring an electric field strength of a fixed value or greater. Further, in a case where the AC bias value is too high, a discharge may occur, or the toner cloud height becomes higher resulting in the adherence of toner to toner controlling means 4. Therefore, the 0.02 to 0.06 mm spacing between the above-mentioned cloud electrode means 2 and the toner carrier 1 makes possible an AC bias value of between ±100 Vpp and ±1000 Vpp.

Furthermore, as described above, the toner carrier 1 is set to 0 V, and a ±voltage (AC) is applied to cloud electrode means 2, but the configuration may be either a reverse configuration, or a configuration that applies a DC voltage as a bias to both the toner carrier 1 and cloud electrode means 2 as needed.

The switching frequency of the AC bias may also be set within a range from 1 to 12 KHz based on the toner clouding efficiency and the toner flight responsiveness.

Means for creating a toner T cloud are configured in accordance with the above.

Toner controlling means 4 is provided with a plurality of toner passage holes (toner passage openings) 41 through which the toner T is able to pass, ring-shaped control electrodes 42 are disposed in the areas surrounding the toner passage holes 41 of the toner supply side surface (surface of the toner carrier 1 side) of this toner controlling means 4, and, in addition, a common electrode 43 that is common to a plurality of toner passage holes 41 is provided with respect to the toner passage holes 41 via an insulation region on the external side of the control electrodes 42.

Figure 3:
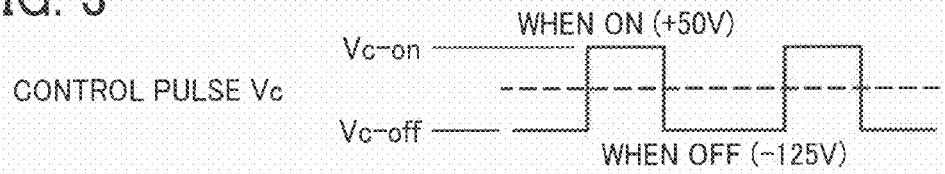
FIG. 3 is a diagram showing an example of a control pulse that is applied to a control electrode.

A control pulse Vc, like that shown in FIG. 3 for example, is applied from control pulse generating means 7 to a control electrode 42 of this toner controlling means 4. In accordance with this, when the toner passage-enabled state (ON state) is established such that the toner T passes through the toner passage hole 41, a voltage Vc-on is applied to the control electrode 42, and when the toner passage-disabled state (OFF state) is established such that the toner T passes through the toner passage hole 41, a voltage Vc-off is applied to the control electrode 42. Further, a voltage Vg is applied to the common electrode 43 from a constant powering means 8. The control electrode 42 of toner controlling means 4 is only able to operate in the area surrounding the toner passage hole 41, but this control electrode 42 may also be disposed either on the inner wall surface of the toner passage hole 41 or on both the inner wall surface of the toner passage hole 41 and the area surrounding the toner passage hole 41 on the toner carrier 1 side.

On the recording medium means 3 side, counter electrode means 5 (a back electrode 5), which is bias voltage applying means for applying a bias voltage for making the toner T that has passed through toner controlling means 4 adhere to recording medium means 3, is disposed on the back face of recording medium means 3, and a bias voltage Vp is applied from bias powering means 9 so that the toner T that has passed through toner controlling means 4 adheres to recording medium means 3.

This recording medium means 3 may be an intermediate recording medium, on which an image is formed one time and transferred to paper thereafter, or a recording paper. The application of the bias voltage Vp to this recording medium means 3, for example, may use a configuration that disposes the back electrode 5 on the back face (the side opposite the toner carrier 1) of recording medium means 3 and causes recording medium means 3 to pass along the upper surface of this back electrode 5, or, in the case of the intermediate recording medium, may be a configuration that embeds an electrode inside this intermediate recording medium (a configuration that makes the electrode on recording medium means side an internal electrode), or a configuration that disposes the back electrode 5 on the back face of the intermediate recording medium.

Figure 4A:
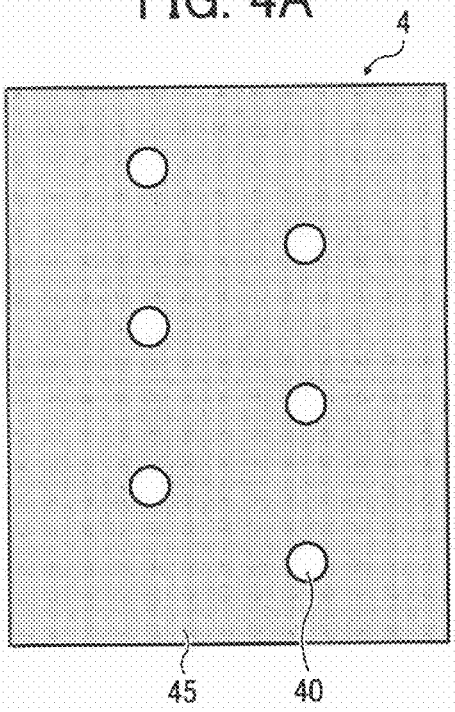
FIG. 4A is a diagram showing the imaging surface side of an example of toner controlling means.
Figure 4B:
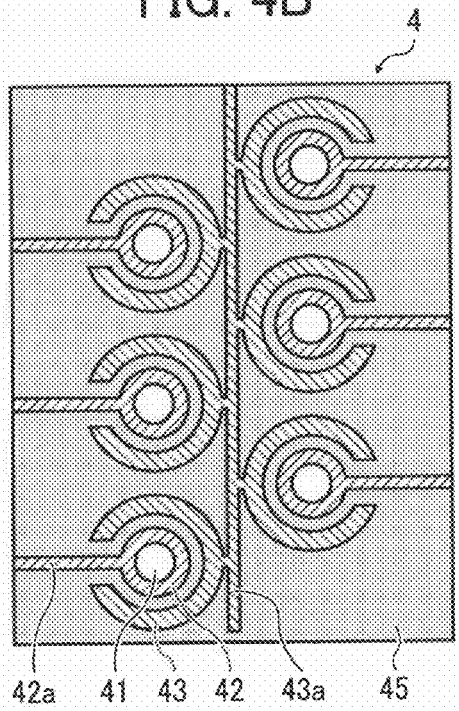
FIG. 4B is a diagram showing the toner supply side of an example of toner controlling means.

Next, an example of a specific configuration of toner controlling means 4 will be explained by referring to FIGS. 4A and 4B. Furthermore, FIG. 4A shows the imaging surface side of toner controlling means 4, and FIG. 4B shows the surface of the toner supplying side of toner controlling means 4.

This example is a configuration, which disposes a 10 μm- to 100 μm-wide ring-shaped control electrode 42 so as to surround a toner passage hole 41 on the surface of the toner supplying side (toner carrier 11 side) of an insulating board (base material) 45, and disposes a common electrode 43, which applies a common bias voltage Vg to a plurality of toner passage holes 41, on the same surface as the control electrode 42 at a spacing of between 20 μm to 50 μm from this control electrode 42, that is, by way of an insulating region formed in the insulating base board 45.

The toner passage hole 41 is determined by the size of the dot to be formed, and has a diameter of between ϕ30 μm and ϕ150 μm. The control electrode 42 is connected to a lead pattern 42*a* for connecting to a driver circuit (drive circuit) for individually controlling the ON/OFF of toner T passage, and the common electrode 43 is connected to a common lead pattern 43*a*. Further, the imaging surface side (surface on the recording medium means 3 side) of the insulating board 45 is in a state in which the toner passage hole 41 is open.

By making the configuration such that the common electrode of toner controlling means is a shape that surrounds the external side of a control electrode in a ring shape by way of an insulating area like this enables the formation of an electric force that forms between recording medium means side bias potential and the common electrode on the external side of the control electrode, thereby eliminating the occurrence of mutual interference (receiving the affects of other toner passage holes) when there is a multi-driver (a driver that causes toner to fly from a plurality of nozzle passage holes).

Further, forming the control electrode and common electrode of toner controlling means on the same surface makes it possible to form these electrodes at the same time in a single manufacturing process, enabling the production of precision, low-cost electrodes.

Figure 5A:
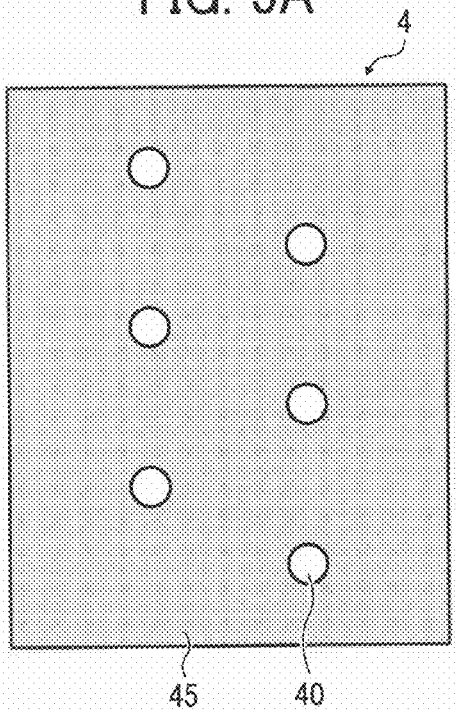
FIG. 5A is a diagram showing the imaging surface side of another example of toner controlling means.
Figure 5B:
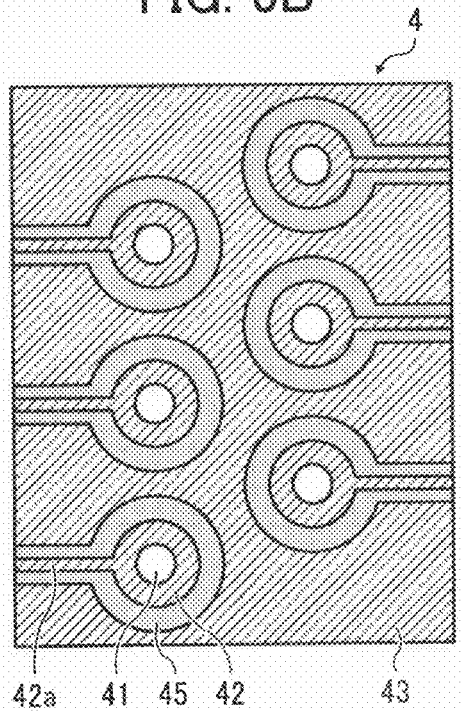
FIG. 5B is a diagram showing the toner supply side of the other example of toner controlling means.

Another example of a specific configuration of toner controlling means 4 will also be explained by referring to FIGS. 5A and 5B. Furthermore, FIG. 5A shows the imaging surface side of toner controlling means 4, and FIG. 5B shows the surface of the toner supplying side of toner controlling means 4.

This example uses a configuration, which disposes a 10 μm- to 100 μm-wide ring-shaped control electrode 42 so as to surround a toner passage hole 41 on the surface of the toner supplying side (toner carrier 11 side) of an insulating board (base material) 45, and disposes a common electrode 43, which applies a common bias voltage Vg to a plurality of toner passage holes 41, in a solid shape so as to cover the entire open space, leaving a space for an insulating region of 20 μm to 50 μm from this control electrode 42.

A configuration in which the common electrode of toner controlling means is disposed in a solid shape by way of an insulating region on the external side of the control electrode like this, that is, forming the common electrode to cover the entire region on the external side of the control electrode, makes it possible to shield the bias potential field of the recording medium means side, and to reduce toner adherence to the control electrode and enhance toner utilization efficiency.

From the aspects of costs and manufacturing processes, a specific manufacturing method for such toner controlling means 4 uses a resin film, for example, a polyimide, PET, PEN, PES or the like, at a thickness of between 30 μm and 100 μm as the insulating member, which is the base material 45, and first uses vapor deposition to form a 0.2 μm- to 1 μm-thick Al film on the surface of the resin film. Next, in a photolithography process, a photoresist is applied using a spinner, after which pre-bake and mask exposure processes are carried out, then subsequent to development, the photoresist is thermally hardened, and thereafter Al patterning is performed using an Al etching solution. In a case where electrode patterning is required on the reverse side of the film, the same processes as those mentioned above are possible, but a pattern to be used as a mask for drilling holes may be formed on the reverse side. The formation of through-holes, which constitute the toner passage holes 41, is possible via high-precision hole processing with no displacement or misregistration using either a mechanical pressing process subsequent to patterning, or excimer laser processing that makes use of a pattern formed on the reverse side, or a dry etching process such as a sputter etching process.

In an image forming apparatus configured like this, the toner T flies from the toner carrier 1 and forms a cloud, and the toner T is transported by the rotation of the toner carrier 1 in accordance with applying a pulse voltage (an AC bias) of an average potential Vs between the toner carrier 1 and cloud electrode means 2 to form the toner cloud. In the meantime, an imaging bias voltage Vp is applied to the back electrode 5 on the side of recording medium means 3.

In this state, a voltage Vg is applied to the common electrode 43 of toner controlling means 4, the ON voltage Vc-on shown in FIG. 3 is applied to the control electrode 42 when setting the state (ON state) in which the toner T is able to pass through the toner passage hole 41, and the OFF voltage Vc-off shown in FIG. 3 is applied to the control electrode 42 when setting the state (OFF state) in which the toner T is not able to pass through the toner passage hole 41.

In accordance with this, setting the voltage with respect to each of these electrodes 11, 5, 42, 43 as will be described further below, causes lines of electric force 10 to be formed in a loop shape between recording medium means 3 side and the common electrode 43 of toner controlling means 4, bypassing the control electrode 42 that controls the passage of the toner, when toner controlling means 4 is set to the state in which the toner T of the toner carrier 1 is able to pass toward recording medium means 3.

Consequently, the toner, which has formed a cloud on the toner carrier 1, rides on the field resulting from the lines of electric force 10, passes through the toner passage hole 41 of toner controlling means 4 and impacts on recording medium means 3. Therefore, a direct toner image is able to be formed on recording medium means 3 by controlling the ON/OFF (switching control) of the respective toner passage holes 41 of toner controlling means 41 in accordance with the image. Then, after the lines of electric force 10 are formed in a loop shape between the recording medium means 3 side and the common electrode 43 of toner controlling means 4, thereby bypassing the control electrode 42 that controls toner passage, the adherence of toner to the control electrode 42 and in the area around the toner passage hole 41 is reduced, and forming the toner cloud enhances toner utilization efficiency.

Figure 6A:
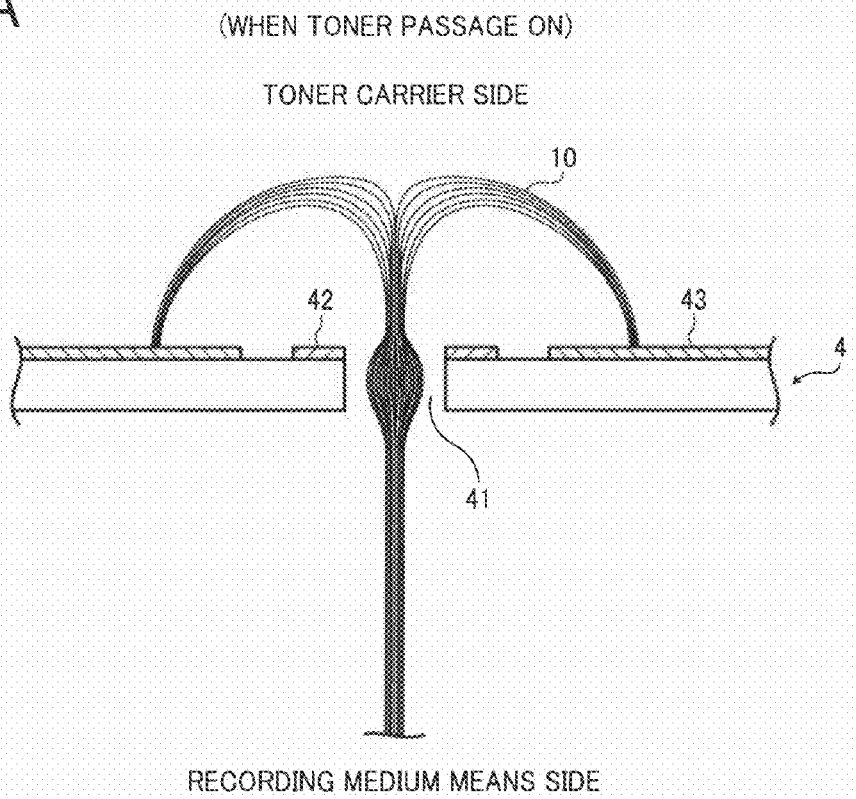
FIG. 6A is a diagram showing lines of electric force passing through a toner passage hole when toner controlling means is in the toner passage-enabled state, based on the results of a two-dimensional cross-sectional field strength distribution simulation.
Figure 6B:
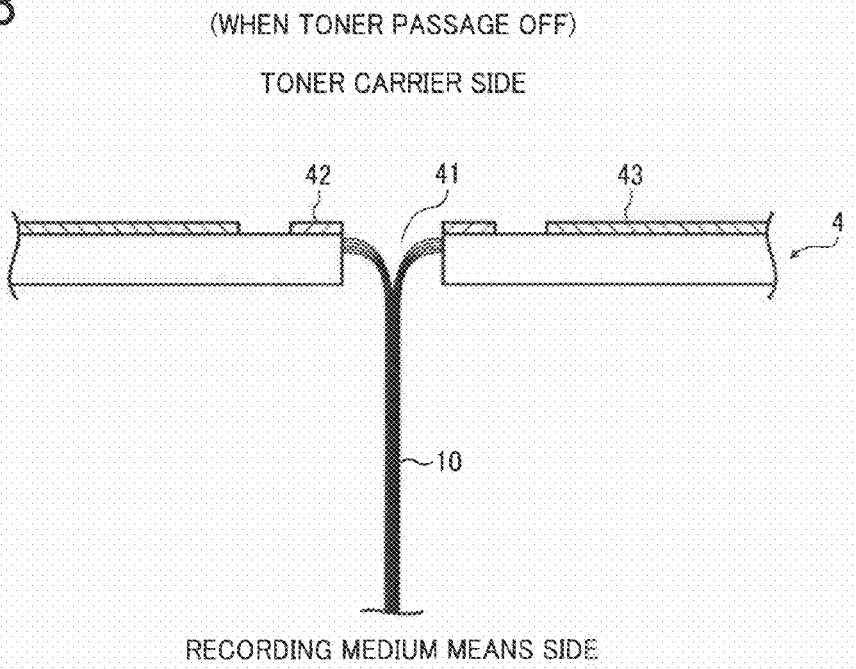
FIG. 6B is a diagram showing electrical force lines passing through a toner passage hole when toner controlling means is in the toner passage-disabled state, based on the results of a two-dimensional cross-sectional field strength distribution simulation.

Accordingly, the AC bias average potential Vs applied for creating the toner T cloud on the toner carrier 1, the bias voltage Vp of the recording medium means 3 side, the control pulse voltage Vc for the control electrode 42 of toner controlling means 4, and the voltage Vg for the common electrode 43 will be explained by referring to FIGS. 6*a* and 6B. Furthermore, FIGS. 6A and 6B show lines of electric force passing through the toner passage hole based on the results of a two-dimensional cross-sectional field strength distribution simulation for the toner carrier 1, toner controlling means 4 and recording medium means 3.

A pulse voltage (the electric potential by which an electric potential temporally fluctuates) of an AC bias average potential Vs is applied for creating a toner T cloud on the toner carrier 1. In accordance with this, the peak-to-peak value of the bias voltage is set in accordance with the spacing of the toner carrier 1 and cloud electrode means 2, and the toner to be used. For example, this value is set within the range of ±60 to ±300 Vpp (pp signifies peak-to-peak).

A voltage with a DC voltage component of 0 V is applied here. Therefore, the DC bias of the toner carrier 1 side with respect to toner controlling means 4 is 0 V, and the average potential Vs=0 V. Furthermore, it is supposed that the spacing d of the toner carrier 1 and toner controlling means 4 is 0.3 mm.

Further, in this example, the diameter of the toner passage hole 41 of toner controlling means 4 is ϕ100 μm, the width of the ring-shaped control electrode 42 across the center of the hole is 30 μm, and the control electrode 42 is spaced 50 μm from the common electrode 43.

The bias voltage Vg to the common electrode 43 of toner controlling means 4 is −125 V DC, and since the relationship with the AC bias average potential Vs applied between the toner carrier 1 and cloud electrode means 2 is such that the toner T is constantly biased in the direction toward the toner carrier 1 side, no toner adheres to the surface of this common electrode 43.

Then, in a case where the control electrode 42 of toner controlling means 4 is set to the state (ON state) in which the toner T is able to pass through the toner passage hole 41, the control pulse voltage Vc-on is +50 V, and in the case of a blocking state (when set to the passage-disabled state) at times other than when the toner T is allowed to pass through the toner passage hole 41, the voltage Vc-off is −125 V. The bias voltage Vp to the back electrode 5 of recording medium means 3 also depends on the spacing between toner controlling means 4 and recording medium means 3, but, for example, between +200 V and +1500 V of DC voltage may be applied. Here, the spacing between toner controlling means 4 and recording medium means 3 is 0.3 mm and +300 V DC is applied, resulting in a potential gradient that draws the negatively charged toner to the surface of recording medium means 3.

When creating a state in which the negatively charged toner is able to pass through the toner passage hole 41, setting the relationships of the electric potentials applied to the respective electrodes 11, 42, 43, 5 as above results in most of the lines of electric force emanating from the electrode 5 of recording medium means 3 side, which have the highest electric potential on the plus side, and which pass through the toner passage hole 41 of toner controlling means 4, entering the lowest electric potential common electrode 43 after passing through the toner passage hole 41. Since there is 175 V of electric potential in the control electrode 42 and the common electrode 43 of toner controlling means 4, which are close together at this time, strong lines of electric force are generated between these electrodes 42, 43 as well.

For this reason, as shown in FIG. 6A, when it is the state (ON state) in which the toner T is able to pass through the toner passage hole 41, the lines of electric force 10 that first pass through the toner passage hole 41 from the electrode 5 of recording medium means 3 side transition to a shape that fans out into a loop so that most of these lines of electric force 10 will enter the common electrode 43, which has the lowest electric potential at −125 V, without entering the control electrode 42 (bypassing the control electrode 42). That is, the lines of electric force 10 are formed into a loop between the recording medium means 3 side and the common electrode 43 of toner controlling means 4 and bypass the control electrode 42.

Therefore, a negatively charged toner T cloud on the toner carrier 1 is able to pass through the toner passage hole 41 along these lines of electric force 10, and most of the toner T is able move to the surface of recording medium means 3.

A voltage of +50 V is applied to the control electrode 42 at this time, and since the relationship with the 0 V of the toner carrier 1 is one in which the toner T is adsorbed to the control electrode 42, by rights the toner T should adhere to the surface of the control electrode 42 while this +50 V is being applied, but as is clear from the results of the simulation shown in FIG. 6A, since the lines of electric force 10, which are passing through the toner passage hole 41 to the common electrode 43 from the electrode of recording medium means 3 side, are hovering over the control electrode 42 to which the +50 V is being applied, the toner T is prevented from adhering to the control electrode 42.

Meanwhile, when in the blocking state (OFF state) in which toner T is not able to pass through the toner passage hole 41, −125 V is applied to the control electrode 42 making the electric potential the same as that of the common electrode 43, and the relationship with the 0 V electric potential of the toner carrier 1 is one in which the toner T is repulsed from the toner carrier 1 side, and since no toner adheres to toner controlling means 4 and, as shown in FIG. 6B, there are no lines of electric force by which the electric force from the electrode of the recording medium means 3 side is able to pass through the toner passage hole 41, the toner T does not pass through the toner passage hole 41 and a scummed image is not generated. Furthermore, the voltage applied to the control electrode 42 in the blocked state (OFF state) does not have to be the same electric potential as that of the common electrode 43, and a higher minus potential is also able to block the passage of the toner T (create an OFF state).

Since this embodiment comprises cloud electrode means for forming a toner cloud between the toner carrier and toner controlling means like this, and is configured such that, when toner controlling means is set to allow the toner of the toner carrier to pass through and move toward recording medium means, the lines of electric force are formed in a loop shape between the recording medium means side and the common electrode of toner controlling means and bypass the control electrode, which controls the passage of the toner, it is possible to greatly reduce toner adherence to the surface of the control electrode to which an electric potential that attracts the toner is being applied, and to the area surrounding this control electrode, and the control of toner passage ON/OFF is able to be carried out stably, and, in addition, the lines of electric force that form between the bias potential of the recording medium means side and the common electrode on the external side of the control electrode expand on the toner carrier side, becoming larger than the diameter of the toner passage hole, making it possible to capture a broad portion of the toner cloud and make it fly toward the imaging surface side, thereby raising the toner utilization efficiency, assuring printing density, and enhancing printing speed. In addition, since cloud electrode means forms a toner cloud, it is possible to create a toner cloud using a simple configuration, to use a low voltage to control toner passage ON/OFF, and to achieve a compact, less expensive image forming apparatus.

In this way, setting the relationship of the electric potentials applied to the respective electrodes as follows when toner passage is ON as described hereinabove makes it possible to form lines of electric force in a loop shape between the recording medium means side and the common electrode of toner controlling means, thereby bypassing the control electrode.

That is, when the state in which the toner is able to pass through the toner passage hole 41 is set with respect to the control electrode 42 of toner controlling means 4 by applying the pulse voltage (AC bias) of an average potential Vs between the toner carrier 1 and cloud electrode means 2, the voltage Vc-on is applied, when setting the state in which the toner is not able to pass through the toner passage hole 41, the voltage Vc-off is applied, and when the voltage Vg is applied to the common electrode 43 and a bias voltage Vp is applied to the recording medium means 3 side to guide the toner that passed through toner controlling means 4 to recording medium means 3 and make the toner adhere to recording medium means 3, the relationship of the respective electric potentials when setting the state in which the toner is able to pass through the toner passage hole 41 is Vp>Vc-on>Vs>Vg, and in a case where the toner is negatively charged toner, the relationship is one in which the bias voltage Vp becomes higher on the plus potential side, and in the case of a positively charged toner, the setting is such that the bias voltage Vp becomes higher on the minus potential side.

In accordance with this, the relationship of the respective electric potentials when setting the state in which the toner is not able to pass through the toner passage hole 41 is Vs>Vg, and, in addition, Vs>Vc-off, and in a case where the toner is negatively charged toner, it is preferable that the relationship be such that the average potential Vs becomes higher on the plus potential side, and in the case of a positively charged toner, it is preferable that the average potential Vs becomes higher on the minus potential side.

Setting the relationship of the electric potentials for the respective electrodes 11, 42, 43, 5 to the above-described relationships reduces the lines of electric force, which are directly formed between the bias potential of the recording medium means side and the potential of the toner carrier, making it possible to form an electric force between the bias potential on the recording medium means side and the common electrode on the external side of the control electrode, and this consequently makes it possible to greatly reduce the adherence of toner to the control electrode to which a toner attracting potential is applied, thereby stabilizing the control potential. Further, since the lines of electric force formed between the bias potential on the recording medium means side and the common electrode on the external side of the control electrode fan out to become larger than the diameter of the toner passage hole on the toner supplying side, it becomes possible to capture a broad portion of the toner cloud and make it fly toward the imaging surface side, thereby making it possible to raise toner utilization efficiency, assure printing density, and enhance printing speed. Furthermore, since the common electrode of toner controlling means is in an electric potential relationship that constantly repulses the toner, toner adherence does not occur, making it possible to keep the common electrode potential constant and enabling the realization of a highly reliable image forming apparatus.

Furthermore, in a case where there is a large amount of toner on the surface of the toner carrier 1 for highspeed printing, or in a case where printing is to be carried out using a toner with a large electrification charge, the toner potential resulting from the toner charge cannot be ignored and must be taken into consideration in determining the electric potential to be applied to the respective electrodes.

Figure 7:
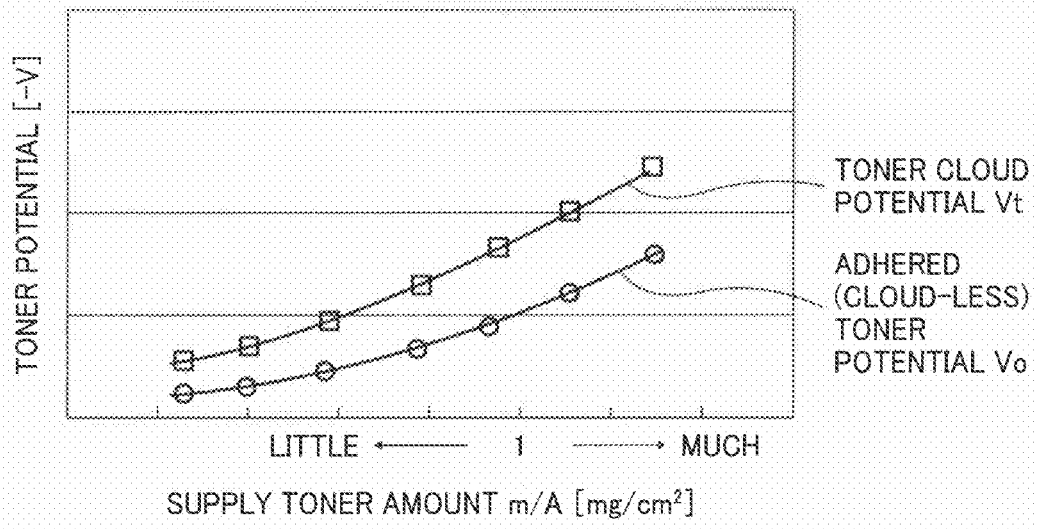
FIG. 7 is a graph showing an example of the relationship between an amount of supply toner and a toner potential.

Specifically, FIG. 7 shows the changes in toner potential with respect to the amount of supply toner m/Amg/cm$^2$ on the surface of the toner carrier 1.

The toner here is an example of a negatively charged toner, and, in accordance with increasing the amount of toner per unit area of the surface of the toner carrier 1, the surface potential as viewed from the control electrode 42 side rises on the minus potential side. Then, the electric potential Vt of the toner cloud, which is achieved by an AC bias being applied between the toner carrier 1 and cloud electrode means 2, rises greatly with respect to the electric potential Vo of the supplied toner simply adhering as-is to the surface of the toner carrier 1. This is because the combined electrostatic capacity of the toner cloud that is in the space over the surface of the toner carrier 1 is smaller than the capacities surrounding the individual toner particles, causing the electric potential to rise as a result.

The measurement of this toner cloud potential Vt may be carried out easily by making the supplied toner into a cloud and setting the surface potentiometer upwardly thereof while applying an AC bias between the toner carrier 1 and cloud electrode means 2. Specifically, measurement is carried out by rotating the toner carrier 1 while applying a pulse that causes clouding and supplying toner from a one-component or two-component roller, which will be described further below, and installing the surface potentiometer about 2 mm above the surface of the toner carrier 1 in the location where toner controlling means 4 is located. The results in FIG. 7 are examples of cases of the Vo when toner having an electrification charge of from −15 to −25 μC/g is supplied, and of the toner potential Vt when this toner is flying at heights up to 200 μm from the proximity of the surface and is in a cloud state.

Figure 8:
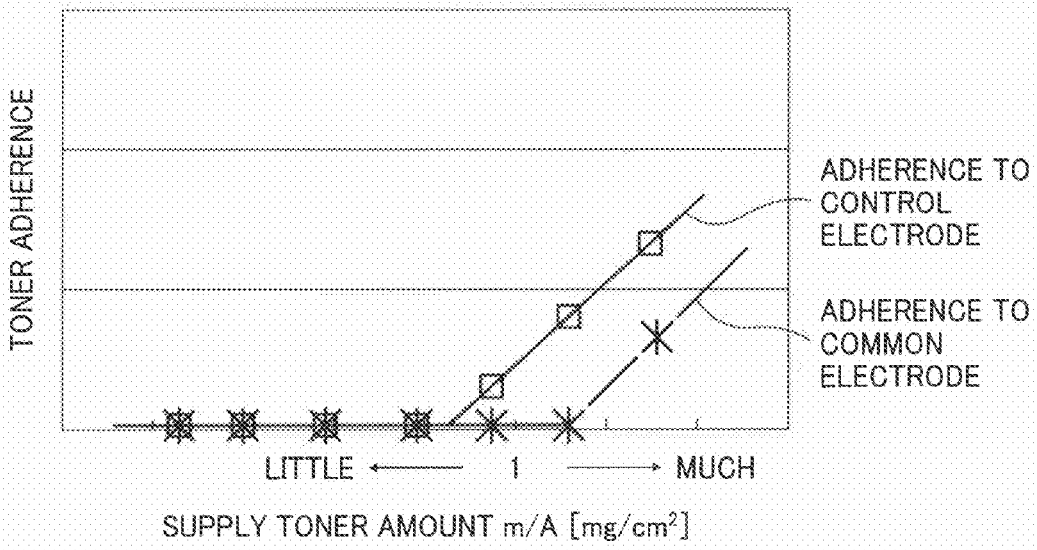
FIG. 8 is a diagram for illustrating the relationship between the amount of supply toner and the adherence of toner to toner controlling means.

FIG. 8 shows the results of printing by carrying out toner passage ON/OFF control using toner controlling means 4 with the respective amounts of supply toner shown in this FIG. 7, and the results of evaluations of the amounts of toner that adhered to the surfaces of the electrodes 42, 43 of toner controlling means 4. In the results shown in FIG. 8, there is no toner adherence to the electrodes 42, 43 in regions where the amount of supply toner is small, but when the amount of supply toner is increased to 0.9 mg/cm$^2$, the toner potential Vt becomes −80 V and the toner begins to adhere to the control electrode 42.

This is because the electric potential of the toner carrier 1 and cloud electrode means 2 rises equivalently on the minus side, and the electric potential difference with the common electrode 42 of toner controlling means 4 becomes smaller, as a result of which, of the lines of electric force emanating from the recording medium means 3 side electrode and passing through the toner passage hole 41, the lines of electric force that directly enter the toner carrier 1 increase, and the loop-shaped lines of electric force that enter the common electrode 43 decrease. That is, this is due to the fact that when the loop-shaped lines of electric force diminish, the high flight energy toner does not ride on the loop-shaped lines of electric force and fly in the direction of the imaging surface, but rather flies up to the control electrode 42 to which ON voltage is being applied.

Furthermore, when the amount of supply toner increases in excess of 1.2 mg/cm$^2$, the toner potential Vt transitions to a value of −120 V or more. In this region, the electric potential difference with the bias potential Vg (−125 V) of the toner controlling means 4 common electrode 43 disappears, with the result that the toner, which has flight energy, begins to reach the common electrode 43 and toner adherence occurs. Further, the amount of toner adhering to the control electrode 42 also increases.

These toner adherences raise the frequency of regular electrode cleanings, and although the image forming apparatus may continue to be used, image quality deteriorates. In a case where conditions are such that toner adherence does not occur, there is no drop in image density even with continuous printing, making a highly reliable image forming apparatus a possibility.

Accordingly, in a case where there is a large amount of toner, or in a case where a toner with a high electrification charge is used to form an image, setting the electric potentials for the respective electrodes using the following conditions will make it possible to avoid toner adherence to the electrodes, enhance toner utilization efficiency, and achieve high-speed printing without a drop in image density.

That is, it is supposed that when the charged toner flies from the toner carrier 1 and the toner potential as viewed from the control electrode 42 where the toner cloud exists is Vt (the other conditions being the same as above), the relationship of the respective electric potentials in a case where toner passage is ON is set to Vp>Vc-on>(Vs+Vt)>Vg, and for negatively charged toner, the relationship is such that the bias voltage Vp becomes higher on the plus potential side, and for positively charged toner, the bias voltage Vp becomes higher on the minus potential side.

Further, the relationships of the respective electric potentials in a case where toner passage is turned OFF are set to (Vs+Vt)>Vg, and, in addition, to (Vs+Vt)>Vc-off, in the case of a negatively charged toner, a relationship such that (Vs+Vt) becomes higher on the plus potential side is set, and in the case of a positively charged toner, a relationship such that the (Vs+Vt) becomes higher on the minus potential side is set.

Setting the electric potentials for the respective electrodes 11, 42, 43, 5 as described hereinabove, that is, properly setting the respective electrode potentials on the toner supply side by also taking into account the electric potential resulting from the toner on the surface of the toner carrier taking flight makes it possible to reduce the adherence of toner on the control electrode and so forth, to enhance toner utilization efficiency, and to realize a high density, highspeed printing image forming apparatus even in a case where the printing speed is fast and there is a large amount of supply toner, or a case in which the toner has a high electrification charge. In accordance with this, even in a state in which toner clouding has not been carried out (a pulse has not been applied), setting the above-described electric potential relationships will enhance reliability because toner will not adhere to the control electrode and the like.

Consequently, this makes the loop-shaped lines of electric force formed from the imaging bias of the recording medium means side to the common electrode of toner controlling means strong, enabling more of the toner cloud to fly toward the imaging surface and making it possible to form high quality dots at highspeed.

Furthermore, in the above examples, the conditions in a case where a clouding pulse (AC bias) is applied between the toner carrier and cloud electrode means to form a toner cloud were explained, but by setting the same conditions as described above when making the toner-based potential, as viewed from the control electrode side in a state in which the toner is not allowed to fly, the Vt, has the effect of avoiding toner adherence to the electrodes. That is, even in a state in which the clouding pulse is not applied and there is no toner cloud, a slight amount of toner is floating around. The electric potential of this slight amount of floating toner may be ignored, but the toner that lands and stays on the surface of the toner carrier has electric potential, and the same effect can be achieved by setting (Vs+Vt), which takes this electric potential Vt into account, to the same range of conditions as mentioned hereinabove.

As described above, the present invention applies a temporally fluctuating electric potential to means for causing the toner on the surface of the toner carrier to fly to form a cloud. In a case where there is no common electrode of toner controlling means here, or a case where the setting of the electric potentials for the respective electrodes is not in the above-described range, toner quickly adheres to the electrodes, making it impossible to avoid a drop in reliability. Further, due to the drastic drop in toner cloud utilization efficiency, it becomes impossible to assure image density and to realize an image forming apparatus that prints at highspeed.

Figure 9:
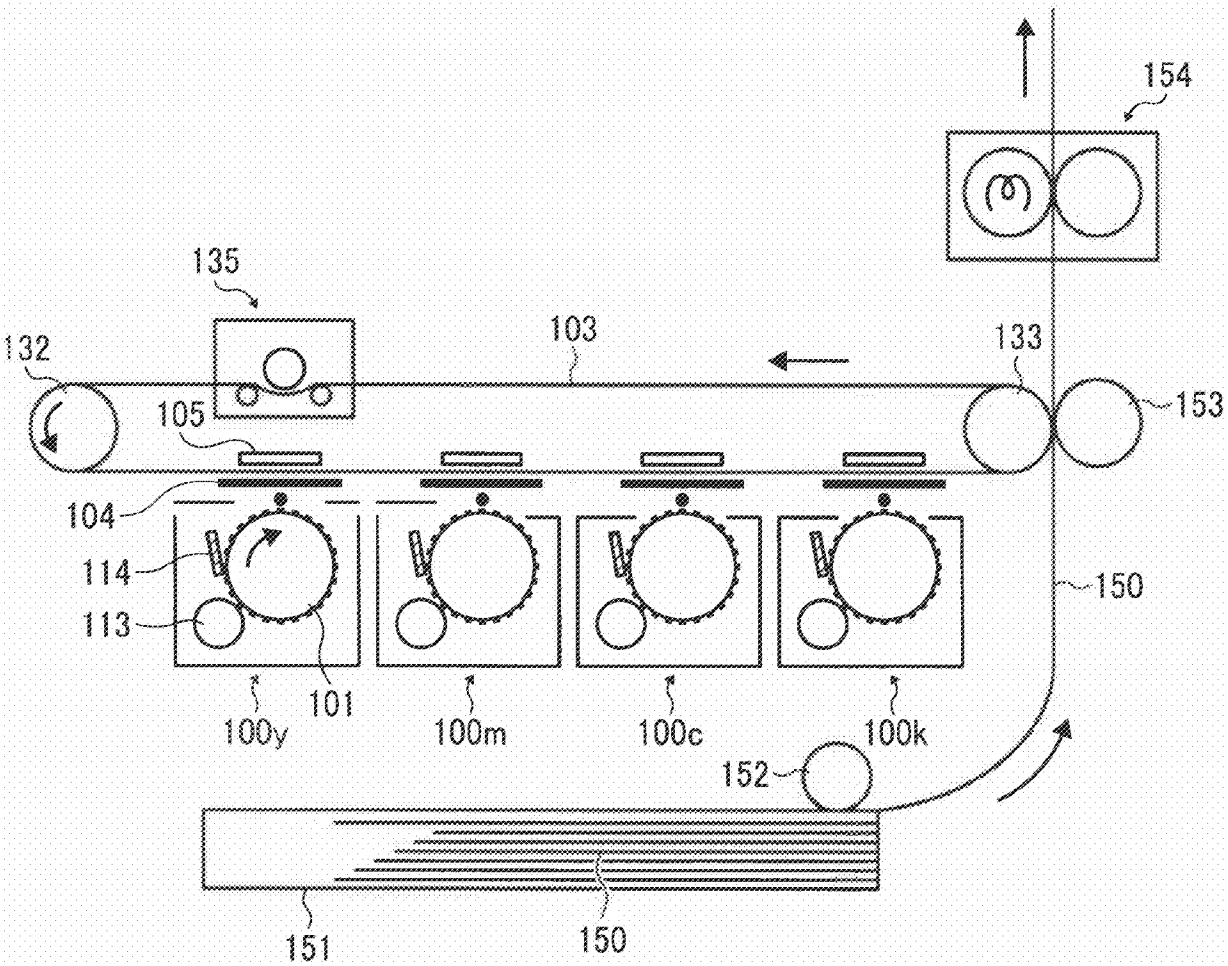
FIG. 9 is a diagram showing an example of the configuration of an image forming apparatus related to the present invention.

Next, an example of the configuration of the image forming apparatus related to the present invention will be explained by referring to FIG. 9.

This image forming apparatus is an example of an image forming apparatus that forms a color image by providing four units of the embodiment described hereinabove, forming toner clouds of the four colors yellow (Y), magenta (M), cyan (C) and black (K), and carrying out ON/OFF control using toner controlling means.

That is, this image forming apparatus disposes four toner supply units 100*y*, 100*m*, 100*c*, 100*k* (called the "toner supply unit 100" when not distinguishing between the colors. The same holds true hereinbelow) for supplying four colors of toner clouds—yellow (Y), magenta (M), cyan (C) and black (K)—along an intermediate recording medium (intermediate recording belt) 103, which is recording medium means, and disposes toner controlling means 104 of the same configuration as the respective toner controlling means 4 of the embodiment described hereinabove between the respective toner supply units 100 and the intermediate recording medium 103.

The intermediate recording medium 103 here is suspended between two rollers 132, 133 and moves in a rotating fashion in the direction of the arrows. Counter electrode means 105, which are electrodes on the recording medium means side, are disposed corresponding to the respective toner supply units 100 on the back face (inner side) of this intermediate recording medium 103. Further, a cleaning unit 135 for removing residual toner from the intermediate recording medium 103 subsequent to transfer is also provided.

The toner supply unit 100 comprises a cylindrical-shaped toner carrier 101, the same cloud electrode means 102 as the above-described cloud electrode means 2 located between this toner carrier 101 and toner controlling means 104, a rotating toner supplying roller 113 that supplies the toner to this toner carrier 101, and a blade 114 for controlling the amount of toner on the toner carrier 101.

In addition to the toner being supplied to the toner carrier 101 by the toner supplying roller 113 here, the frictional electrification of the toner is carried out by the friction generated between the toner on the toner supplying roller 113 and the toner carrier 101. Further, the blade 114 on the downstream side of the toner supplying roller 113 maintains the amount of toner on the surface of the toner carrier 101 at a thin layer, and also serves to stabilize the magnitude of the toner charge.

Then, the toner supplied by the toner supply unit 100 is formed into a cloud above the toner carrier 101 by applying an AC bias between the toner carrier 101 and cloud electrode means 102, the toner is flown onto the intermediate recording medium 103 by toner controlling means 104 controlling the ON/OFF in accordance with the image, and a color toner image is formed on the intermediate recording medium 103.

In the meantime, a paper feeding unit 151 that accommodates recording paper 150 is disposed at the bottom, recording paper 150 is fed from the paper feeding unit 151 by a pickup roller (paper feeding roller) 152, the toner image on the intermediate recording medium 103 is transferred to the recording paper 150 by a transfer roller 153, which is disposed facing the roller 132 around which the intermediate recording medium 103 is suspended, and the toner is melting and fixed onto the recording paper 150 by a fixing unit 154.

Furthermore, although not shown in the drawing here, toner image transfer from the intermediate recording medium 103 to the recording paper 150 is carried out by applying a +bias to the transfer roller 153 of the back face of the recording paper 150. Further, as mentioned above, residual toner left on the intermediate recording medium 103 is cleaned off by the cleaning unit 135, and the next image formation is carried out.

In this way, this image forming apparatus is an intermediate transfer recording system that forms a four-color image on an intermediate recording medium, and thereafter transfers this image to a piece of recording paper supplied from a paper feeding unit. In the case of this intermediate transfer recording system, it is easy to assure the precision that maintains a constant interval between the imaging surface (also called the toner impacting surface and the image forming surface) and toner controlling means, making it possible to achieve high image quality under low toner flight speed conditions. Further, an image forming apparatus, which prevents the build up of charges by smoothly adjusting volume resistivity, achieves an electric potential fluctuation-free imaging surface, and carries out direct printing by turning ON/OFF the passage of a toner cloud, is highly sensitive to electric potential and is susceptible to fluctuations in quality in response to fluctuations in image surface bias potential, but this configuration makes it possible to achieve high reliability and high-quality color images.

Figure 10:
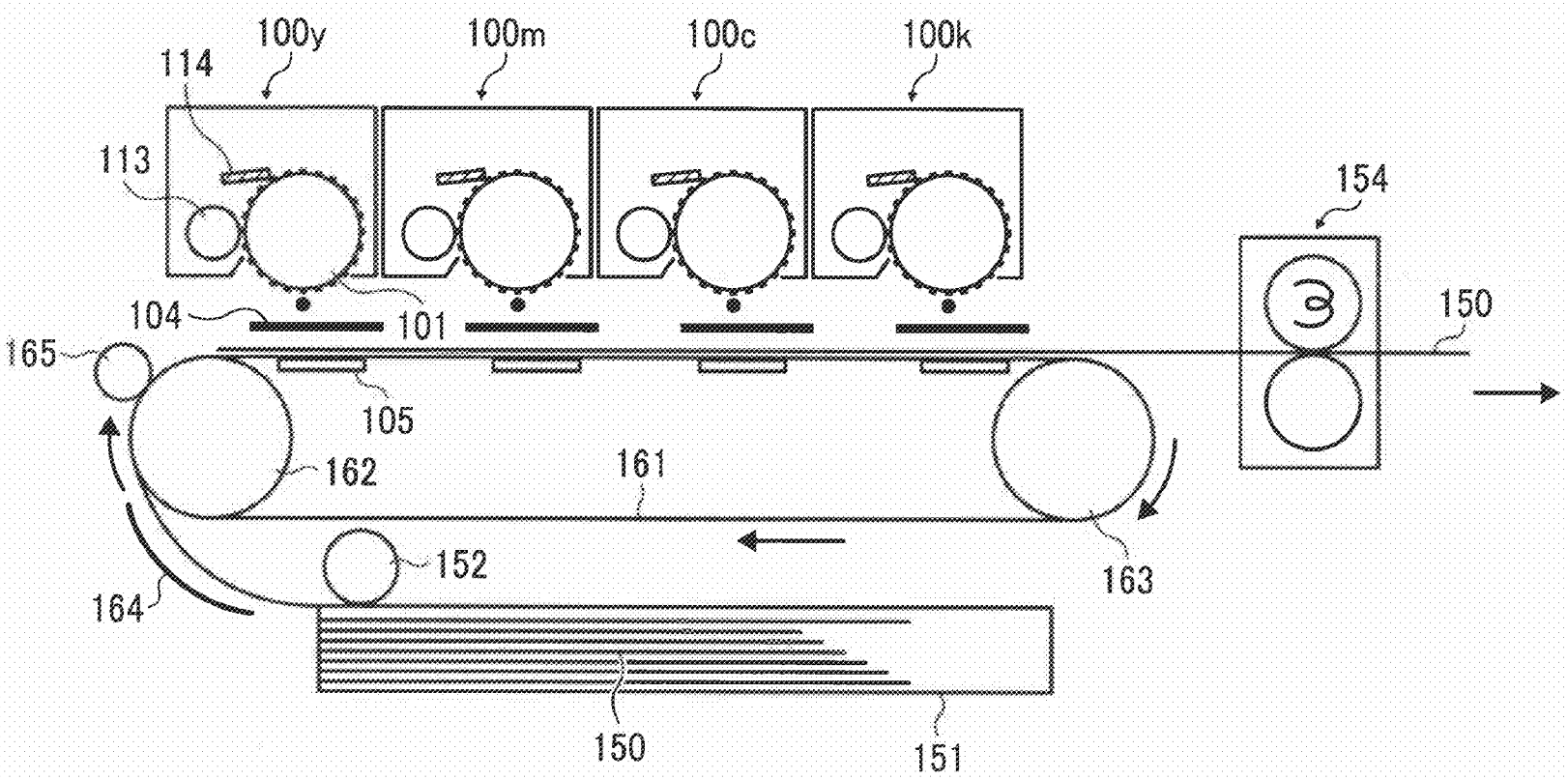
FIG. 10 is a diagram showing another example of the configuration of an image forming apparatus related to the present invention.

Next, another example of the configuration of the image forming apparatus related to the present invention will be explained by referring to FIG. 10.

This image forming apparatus is an example in which recording medium means is recording paper, and an image is formed directly on the recording paper. That is, the recording paper 150 provided from the paper feeding unit 151 here is electrostatically clamped to a paper conveyer belt 161, passed through a region of toner supply units 100, and a color image is formed directly on the recording paper 150 by controlling the ON/OFF of toner controlling means 104 in accordance with the image.

Furthermore, the paper conveying belt 161 is formed from polyimide, suspended around two rollers 162, 163, moves in a rotating manner in the direction of the arrows, and electrostatically clamps, holds and conveys the recording paper 150 by being charged by a charging roller or other such charging means not shown in the drawing. Furthermore, a guide 164 for guiding the recording paper 150 from the paper feeding unit 151 to the paper conveying belt 161, a resistance roller 165 and the like are also provided.

In this configuration, since there are a polyimide or other such paper conveying belt 161 and recording paper 150 between toner controlling means 104, which controls toner passage, and the back electrode 105, which applies a bias for guiding the toner to the recording paper 150 subsequent to passage, it is impossible to set the spacing of toner controlling means 104 and the back electrode 105 extremely narrowly, but on the other hand, since a color image is formed directly on the recording paper 150 and there is no transfer process, a drop in image quality due to toner spatter at transfer time is eliminated.

Also, there is no need for a belt cleaning mechanism like that in the configuration explained above using FIG. 9, making this configuration advantageous for realizing a compact, low-cost image forming apparatus. In this configuration, which forms a toner cloud, it is also possible to guide the toner by setting a low imaging surface bias, thereby making it possible to lower the speed of toner impact on the paper and to achieve a high-quality image forming apparatus in which toner spatter does not occur.

Next, an example of the specific configuration of the toner supply unit 100 in the above-described image forming apparatus will be explained by referring to FIG. 11.

This toner supply unit 100 is an example which uses a two-component recording agent comprising a magnetic carrier and a non-magnetic toner. A recording agent storage portion 201 is divided into two chambers 201A, 201B, and these chambers 201A, 201B are connected by a recording agent corridor (not shown in the drawing) at both ends inside of the toner supply unit 100. The two-component recording agent is stored in the recording agent storage portion 201, and is conveyed inside the recording agent storage portion 201 while being mixed by mixing/conveying screws 202A, 202B in the respective chambers 201A, 201B.

A toner supply opening 203 is disposed in chamber 201A of the recording agent storage portion 201, and toner is supplied to the inside of the recording agent storage portion 201 through the toner supply opening 203 from a toner storage portion not shown in the drawing. A toner concentration sensor not shown in the drawing is installed in the recording agent storage portion 201 for detecting the magnetic permeability of the recording agent, and detects the concentration of the recording agent. When the concentration of the toner in the recording agent storage portion 201 decreases, toner is supplied to the inside of the recording agent storage portion 201 from the toner supply opening 203.

Then, a magnetic brush roller 204 is disposed as a toner supply roller in a location facing the mixing/conveying screw 202B. Fixed magnets are disposed on the inside of the magnetic brush roller 204, and the recording agent inside the recording agent storage portion 201 is drawn up to the surface of the magnetic brush roller 204 by the rotation and magnetic force of the magnetic brush roller 204. A recording agent level controlling member 205 is provided in a location facing the magnetic brush roller 204 upstream from the recording agent draw-up location in the direction of the rotation of the magnetic brush roller 204.

The recording agent drawn up at the draw-up location is controlled to a fixed thickness by the recording agent level controlling member 205. The recording agent that passes through the recording agent level controlling member 205 is conveyed to a location opposite the toner carrier 101 in line with the rotation of the magnetic brush roller 204. A supplying bias is applied to the magnetic brush roller 204 by first voltage applying means 211.

The toner carrier 101 is grounded (it is 0 V). Cloud electrode means 102 is disposed in front of this toner carrier 101, and an AC bias is applied from AC bias powering means 212.

At this point, an electric field is created between the toner carrier 101 and the magnetic brush roller 204 by voltage applying means 211 at a location facing the magnetic brush roller 204 of the toner carrier 101. In response to the electrostatic force from this electric field, the toner separates from the carrier, moves to the surface of the toner carrier 101, and is conveyed by the rotation of the toner carrier 101. Then, the toner on the surface of the toner carrier 101, which has been conveyed to a location opposite cloud electrode means 102 is formed into a cloud by an AC bias applied between the toner carrier 101 and cloud electrode means 102.

Then, toner dot imaging is controlled by causing the toner to selectively fly to the recording medium means side in accordance with the toner passage ON/OFF control field of the control electrode 42 of toner controlling means 104.

Figure 12:
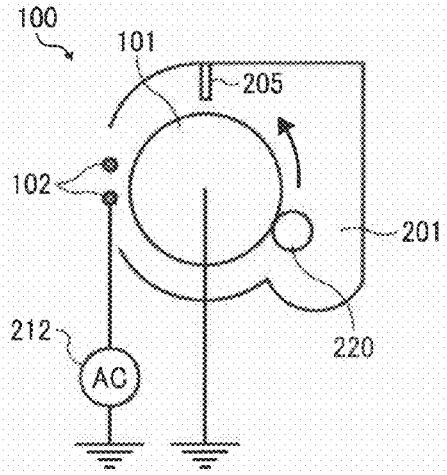
FIG. 12 is a diagram showing another example of the configuration of the toner supply unit.

Next, another example of a specific configuration of the toner supply unit 100 of the above-described image forming apparatus will be explained by referring to FIG. 12.

This toner supply unit 100 is an example of a one-component recording agent comprising a non-magnetic toner. The toner is stored in a recording agent storage portion 201, and the toner is subjected to frictional electrification with respect to the toner carrier 101 by a charging roller 220, maintained at a thin layer by a recording agent level controlling member 205, and conveyed by the rotation of the toner carrier 101. Then, the toner on the surface of the toner carrier 101, which has been conveyed to a location facing cloud electrode means 102, is made into a cloud by an AC bias applied between the toner carrier 101 and cloud electrode means 102.

Then, toner dot imaging is controlled by causing the toner to selectively fly to the recording medium means side in accordance with the toner passage ON/OFF control field of the control electrode 42 of toner controlling means 104.

Figure 13:
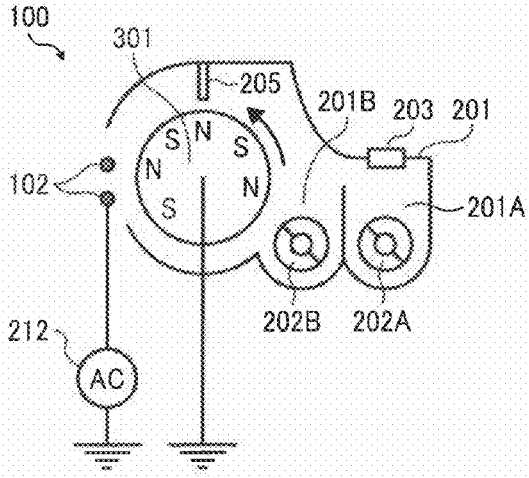
FIG. 13 is a diagram showing yet another example of the configuration of the toner supply unit.

Next, yet another example of a specific configuration of the toner supply unit 100 of the above-described image forming apparatus will be explained by referring to FIG. 13.

Figure 11:
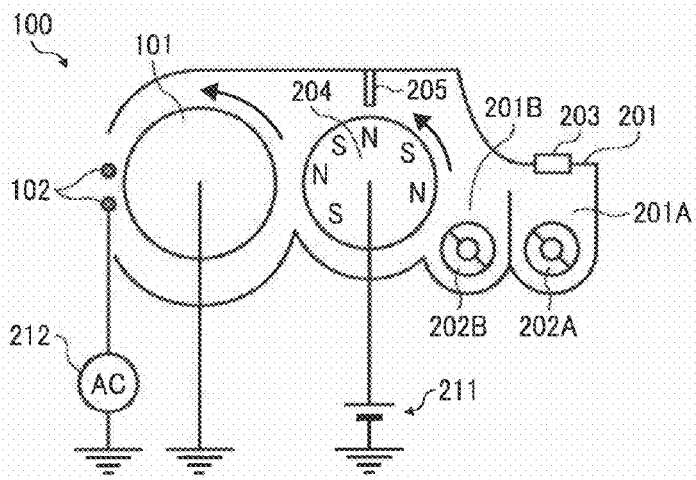
FIG. 11 is a diagram showing an example of the configuration of a toner supply unit.

This toner supply unit 100 uses a two-component recording agent comprising a magnetic carrier and a non-magnetic toner, and the same as the example of FIG. 11, a recording agent storage portion 201 is divided into two chambers 201A, 201B, and these chambers 201A, 201B are connected by a recording agent corridor (not shown in the drawing) at both ends inside of the toner supply unit 100. The two-component recording agent is stored in the recording agent storage portion 201, and is conveyed inside the recording agent storage portion 201 while being mixed by mixing/conveying screws 202A, 202B in the respective chambers 201A, 201B.

A toner supply opening 203 and a toner concentration sensor are disposed in chamber 201A of the recording agent storage portion 201, and the toner concentration sensor detects the concentration of the recording agent. When the concentration of the toner in the recording agent storage portion 201 decreases, toner is supplied to the inside of the recording agent storage portion 201 from the toner supply opening 203.

Then, a magnetic brush roller 301 is disposed as a toner carrier in a location facing the mixing/conveying screw 202B, fixed magnets are disposed on the inside of the magnetic brush roller 301, and the recording agent inside the recording agent storage portion 201 is drawn up to the surface of the magnetic brush roller 301 by the rotation and magnetic force of the magnetic brush roller 301. A recording agent level controlling member 205 is provided in a location facing the magnetic brush roller 301 upstream from the recording agent draw-up location in the direction of the rotation of the magnetic brush roller 301.

The recording agent drawn up at the draw-up location is controlled to a fixed thickness by the recording agent level controlling member 205, and conveyed in the direction of cloud electrode means 102. This magnetic brush roller 301, which is the toner carrier, is grounded (it is 0 V), and a toner cloud is formed in accordance with an AC bias being applied between the magnetic brush roller 301 and cloud electrode means 102.

Then, toner dot imaging is controlled by causing the toner to selectively fly to the recording medium means side by the toner passage ON/OFF control field of the control electrode 42 of toner controlling means 104.

Furthermore, the toner in these respective toner supply units 100 that did not contribute to imaging is again conveyed by the toner carrier 101, and recovered from the surface of the toner carrier 101 by not-shown recovering means. The recovered toner is returned to the recording agent storage portion 201 once again, and circulated around inside the toner supply unit 100.

Negatively charged toner is mainly used in the examples explained hereinabove, but positively charged toner may also be used.

According to the above-described image forming apparatus related to the present invention, the configuration is such that cloud electrode means for creating a toner cloud is provided between the toner carrier and toner controlling means, and when toner controlling means is set so that the toner of the toner carrier is able to pass toward recording medium means, loop-shaped lines of electric force are formed between the recording medium means side and the common electrode of toner controlling means, bypassing the control electrode for controlling the passage of the toner, thereby making it possible to form a toner cloud using a simple configuration and to perform toner passage ON/OFF using low voltage, and, in addition, it is also possible to reduce the adherence of toner to the surface of toner controlling means and around the toner passage holes, to stably carry out toner passage ON/OFF control, to improve toner utilization efficiency, and to achieve a compact, low-cost image forming apparatus.

Various modifications will become possible for those skilled in the art after receiving the teachings of the present disclosure without departing from the scope thereof.

What is claimed is:

1. An image forming apparatus, comprising:

a toner carrier for carrying a toner;

recording medium means to which the toner is made to adhere;

toner controlling means, disposed between the toner carrier and the recording medium means, and having a plurality of toner passage holes; and cloud electrode means, disposed between the toner carrier and the toner controlling means, wherein an AC bias is applied between the toner carrier and the cloud electrode means to temporally change between an electric field, in which force to move toner from the toner carrier to the cloud electrode means is acted, and an electric field, in which force is acted in an opposite direction thereto, a control electrode for controlling passage of the toner is disposed at least in either an area surrounding a toner passage hole or on an inner wall of this hole on a surface of the toner controlling means on a side of the toner carrier, and when the toner of the toner carrier is able to pass through the toner passage hole of the toner controlling means toward the recording medium means, a loop-shaped line of electric force is formed between the recording medium means side and a common electrode of the toner controlling means, the loop-shaped line by-passing the control electrode.

2. The image forming apparatus according to claim 1, wherein the AC bias of an average potential Vs is applied between the toner carrier and the cloud electrode means, a voltage Vc-on is applied to the control electrode of the toner controlling means when the toner is able to pass through the toner passage hole, a voltage Vc-off is applied to the control electrode of the toner controlling means when the toner is unable to pass through the toner passage hole, and a voltage Vg is applied to the common electrode, and when a bias voltage Vp is applied to the recording medium means side to guide the toner that has passed through the toner controlling means to the recording medium means and to cause the toner to adhere to the recording medium means, a relationship between respective electric potentials when the toner is able to pass through the toner passage hole is expressed by:

$$Vp > Vc\text{-on} > Vs > Vg$$

and the relationship is such that the bias voltage Vp becomes higher on a plus potential side in a case where the toner is negatively charged toner, and the bias voltage Vp becomes higher on a minus potential side in the case of a positively charged toner.

3. The image forming apparatus according to claim 2, wherein the relationship between the respective electric potentials when the toner is not able to pass through the toner passage hole is expressed by:

$$Vs > Vg,$$

and, in addition, $$Vs > Vc\text{-off},$$

and the relationship is such that the average potential Vs becomes higher on the plus potential side in a case where the toner is negatively charged toner, and the average potential Vs becomes higher on the minus potential side in the case of a positively charged toner.

4. The image forming apparatus according to claim 1, wherein the AC bias of an average potential Vs is applied between the toner carrier and the cloud electrode means, a voltage Vc-on is applied to the control electrode of the toner controlling means when the toner is able to pass through the toner passage hole, a voltage Vc-off is applied to the control electrode of the toner controlling means when the toner is unable to pass through the toner passage hole, and a voltage Vg is applied to the common electrode, and when a bias voltage Vp is applied to the recording medium means side to guide the toner that has passed through the toner controlling means to the recording medium means and to cause the toner to adhere to the recording medium means, in a state in which the toner exists on the surface of the toner carrier and around the cloud electrode means, and when the potential in accordance with the toner is Vt when the toner carrier is viewed from the control electrode side of the toner controlling means, the relationship between respective electric potentials when the toner is able to pass through the toner passage hole is expressed by:

$$Vp > Vc\text{-on} > (Vs+Vt) > Vg,$$

and the relationship is such that the bias voltage Vp becomes higher on a plus potential side in a case where the toner is negatively charged toner, and the bias voltage Vp becomes higher on a minus potential side in the case of a positively charged toner.

5. The image forming apparatus according to claim 4, wherein the relationship between the respective electric potentials when the toner is not able to pass through the toner passage hole is expressed by:

$$(Vs+Vt) > Vg,$$

and, in addition, $$(Vs+Vt) > Vc\text{-off},$$

and the relationship is such that the potential (Vs+Vt) becomes higher on the plus potential side in a case where the toner is negatively charged toner, and the potential (Vs+Vt) becomes higher on the minus potential side in the case of a positively charged toner.

6. The image forming apparatus according to claim 1, wherein the cloud electrode means is a wire member.

7. The image forming apparatus according to claim 1, wherein the toner carrier is a magnetic brush roller, which uses a two-component recording agent comprising a magnetic carrier and a toner, and a toner cloud is formed by applying the AC bias between the magnetic brush roller and the cloud electrode means.

8. The image forming apparatus according to claim 1, wherein the toner carrier is a one-component roller that carries a one-component recording agent comprising a toner, and a toner cloud is formed by applying the AC bias between the one-component roller and the cloud electrode means.

9. The image forming apparatus according to claim 1, wherein the toner carrier is an intermediate roller for forming a layer of toner that is supplied from a magnetic brush roller, which uses a two-component recording agent comprising a magnetic carrier and a toner, and a toner cloud is formed by applying the AC bias between the intermediate roller and the cloud electrode means.

10. The image forming apparatus according to claim 1, wherein the common electrode for the toner controlling means has a shape that surrounds an external side of the control electrode in a ring shape by way of an insulating area.

11. The image forming apparatus according to claim 1, wherein the common electrode for the toner controlling means is disposed in a solid shape by way of an insulating region on an external side of the control electrode.

12. The image forming apparatus according to claim 1, wherein the recording medium means is recording paper, and a bias voltage is applied to electrode means disposed on the back face of the recording paper.

13. The image forming apparatus according to claim 1, wherein the recording medium means is an intermediate transfer medium, and a bias voltage is applied to electrode means disposed on either the intermediate transfer medium itself or the back face of the intermediate transfer medium.

14. The image forming apparatus according to claim 1, wherein a color image is formed on the recording medium means by superimposing different colors of the toner.

15. An image forming apparatus, comprising:

a toner carrier for carrying a toner;

a recording medium to which the toner is made to adhere;

a toner controlling device disposed between the toner carrier and the recording medium and having a plurality of toner passage holes; and a cloud electrode device disposed between the toner carrier and the toner controlling device, wherein an AC bias is applied between the toner carrier and the cloud electrode device to temporally change between an electric field, in which force to move toner from the toner carrier to the cloud electrode device is acted, and an electric field, in which force is acted in an opposite direction thereto, a control electrode for controlling passage of the toner is disposed at least in either an area surrounding a toner passage hole or on an inner wall of this hole on a surface of the toner controlling device on a side of the toner carrier, and when the toner of the toner carrier is able to pass through the toner passage hole of the toner controlling device toward the recording medium, a loop-shaped line of electric force is formed between the recording medium device side and a common electrode of the toner controlling device, the loop-shaped line by-passing the control electrode.

* * * * *